United States Patent [19]

Porepp

[11] 3,976,106

[45] Aug. 24, 1976

[54] METHOD OF MAKING A SLIDE FASTENER

[76] Inventor: Bernd Porepp, Ortsteil Wangen, Am Rebberg 16, 7763 Oehningen, Germany

[22] Filed: July 21, 1975

[21] Appl. No.: 597,453

[30] Foreign Application Priority Data

July 19, 1974 Germany ..... 2434978

[52] U.S. Cl. ..... 139/384 B; 24/205.16 C; 139/11; 139/35

[51] Int. Cl.[2] ..... D03D 41/00; A44B 19/42

[58] Field of Search ..... 139/384 B, 35, 11, 116, 139/118; 24/208.13 C, 208.16 C

[56] References Cited

UNITED STATES PATENTS

| | | | |
|---|---|---|---|
| 3,796,237 | 3/1974 | Heidermann | 139/384 B |
| 3,871,420 | 3/1975 | Jakob | 139/116 |
| 3,905,401 | 9/1975 | Steingruebner | 139/124 R |

FOREIGN PATENTS OR APPLICATIONS

| | | | |
|---|---|---|---|
| 1,945,315 | 11/1971 | Germany | 139/384 B |

*Primary Examiner*—Henry S. Jaudon
*Attorney, Agent, or Firm*—Howard C. Miskin

[57] ABSTRACT

A helical series of slide fastener links is fed parallel to warp threads and the filling threads are inserted to weave the tape. The helical or meandering series of slide fastener links is extended adjacent to the zero plane of the weaving machine and is moved along a straight line and without formation of a shed during the weaving operation. At least two joining warp threads are warped which are spaced from the series of slide fastener links and disposed before the coupling surfaces thereof. Warp threads of the backing woven fabric are warped on the other side of the series of slide fastener links. Two joining warp threads lying in upper and lower sheds are formed into a first shed. The warp threads of the backing woven fabric and any remaining joining warp threads lying in a middle shed and the lower shed are formed into a second shed. A double shot for weaving the strap is inserted into the second shed and at the same time that joining warp thread of the first shed which lies in the upper shed is pushed onto a tuck needle to form a chain of loops for fixing the series of slide fastener links to the strap. The joining warp thread lying in the upper shed is then moved into the lower or middle shed during the subsequent shedding operation or operations. Any remaining joining warp threads are successively moved into the upper shed when they have participated in the formation of the second shed for weaving the strap. Selvages are formed at the respective edges of the strap.

4 Claims, 4 Drawing Figures

METHOD OF MAKING A SLIDE FASTENER

This invention relates to a method of weaving a slide fastener in which a helical or meandering series of slide fastener links is fed parallel to warp threads and the filling threads are inserted to weave the strap.

Series of slide fastener links made from a synthetic thermoplastic monofilament and intended for use in the slide fasteners according to the invention are known, e.g., from Opened German Specifications Nos. 1,660,799 and 1,660,288, in the form of flattened helical springs or meanders bent in U-shape having individual turns or links provided with coupling surfaces. Such helical series of slide fastener links are sewed to a woven tape by means of a sewing machine, in which the needle penetrates between the turns and the needle thread is tied by a looper thread. The resulting loop is forwarded to the next turn in that the helix is advanced by one turn. The sewing machine needle then penetrates the next turn and the cycle of operation is continually repeated. The connection of helical or meandering series slide fastener links to a strap by a sewing machine requires not only a high capital investment to procure the special sewing machines but the sewing of the series of slide fastener links to the strap constitutes an additional operation which is time-consuming and requires additional labor. Besides, pitch errors cannot be reliably precluded when the series of slide fastener links are sewed to the strap.

Known weaving methods of making slide fasteners are faster and more efficient. The Opened German Specification No. 2,263,892 discloses a weaving method of making slide fasteners, in which the slide fastener helix is first entered in the form of a straight-line monofilament as a filling thread between warp threads. In a manner which is not described in detail, the helix as such is formed only during the weaving operation and is fixed in and held by the warp threads. That weaving method has the disadvantage that the helix is fixed only during the weaving operation by the warp threads. A thermal aftertreatment is usually required to fix the helix. The helix as such is not sufficiently anchored in the warp threads so that the precision and stability of the slide fastener may be adversely affected to a high degree.

The slide fastener described in the Opened German Specification No. 2,263,892 can allegedly be made also in that the monofilament which has been shaped into a continuous helix is woven in during the weaving operation like the warp along the edge portion of the strap. In this operation, pairs of filling threads are inserted and formed into loops which tie each other and which extend upwardly above the legs of the series of slide fastener links. The Opened German Specification No. 2,263,892 does not describe how the weaving method can be carried out in practice.

In a known method, a helical series of slide fastener links is supplied through a tube which serves as a warp thread and participates in the formation of a shed. As the shed is formed, the tube is pivotally moved downwardly and upwardly through the zero plan so that the filling threads which are entered slip off the tube and enter between the turns. The helix disposed in the tube is advanced by a gear in steps corresponding to the pitch thereof. Because during the formation of the shed the outlet opening of the tube departs from the zero plane and part of the helix is thus pulled or moved out of the tube, it is not possible always to define exactly that turn into which the filling is inserted. For this reason in that known method different numbers of filling threads may enter each turn even if a plurality of shots are inserted. This is due to the fact that from the aspect of weaving technology the helix constitutes a warp thread on which the filling threads which have been inserted cannot slide because they are located in the turns. For this reason the known weaving method results in irregularly located slide fasteners, which may also have pitch defects. Because only one needle is used in the known weaving method, the filling threads are pulled into those arcs of the turns of the series of slide fastener links which are opposite to the coupling surfaces so that these arcs are filled by the woven fabric. As a result, when the complete slide fastener has been woven the slide slides on the woven fabric and may destroy the same.

It is an object of the invention to provide a method which is economical and can be carried out in a simple manner and serves to make slide fasteners in which the helical or meandering series of links is joined by weaving and fixed to the tape by joining threads with a highly accurate pitch.

In a method of the kind defined first hereinbefore, this object is accomplished in that the helical or meandering series of slide fastener links is extended adjacent to the zero plane of the weaving machine and is moved along a straight line and without formation of a shed during the weaving operation, in that at least two joining warp threads are fed which are spaced from the series of slide fastener links and disposed before the coupling surfaces thereof, that warp threads of the backing woven fabric are fed on the other side of the series of slide fastener links, that two joining warp threads lying in upper and lower sheds are formed into a first shed and the warp threads of the backing woven fabric and any remaining joining warp threads lying in a middle shed and the lower shed are formed into a second shed, that a double shot for weaving the strap is inserted into the second shed and at the same time that joining warp thread of the first shed which lies in the upper shed is pushed onto a tuck needle to form a chain of loops for fixing the series of slide fastener links to the strap, that the joining warp thread lying in the upper shed is then moved into the lower or middle shed during the subsequent shedding operation or operations, that any remaining joining warp threads are successively moved into the upper shed when they have participated in the formation of the second shed for weaving the strap, and that selvages are formed at the respective edges of the strap. In the process according to the invention the weaving of the strap and the joining of the series of slide fastener links to the strap by weaving are performed at the same time and in a single operation so that there is no need for subsequent operations to sew the series of slide fastener links to the tape and the expenditure in equipment and labor otherwise involved in such subsequent operations is avoided. The inventor has recognized that a particularly simple and suitable weaving method of making slide fasteners can be provided in that the warp threads used to tie the series of slide fastener links are interconnected to form a chain of loops. The series of slide fastener links is supplied through a tube, which is fixed to the machine and extends adjacent to the zero plane of the weaving machine. This tube is flattened so that the series of slide fastener links cannot rotate in the tube. The chain of loops which join the series of slide fastener links to the strap is formed closely before the outlet opening of the tube. The changing of the shed results in a crossing and tying of the roots of the chain of loops which fix the series of slide fastener links and these crossed roots are pushed off the forward end of the tube and moved with a proper pitch between the legs of the series of slide fastener links by the reed, two dents of which are disposed on opposite sides of the tube. The joining warp threads forming the chain of loops are held taut by resilient arms, which are provided at their forward ends with eyelets through which the joining warp threads extend. For this reason, the joining warp threads can be transferred to the tuck needle from a fork which is moved parallel to the picking needle, and when the tuck needle has been retracted and the joining warp threads have been pushed off the supply tube the loops which have slipped off the tuck needle are pulled tight.

The method according to the invention can be carried out on commercially available weaving machines after relatively small alterations. It is sufficient to provide the weaving machines with the tube for supplying the series of slide fastener links, a tuck fork, which is moved above the series of slide fastener links in a direction parallel to the picking needle, a picking needle for removing the joining warp threads from the tuck fork so as to form loops, and resilient arms for holding the joining warp threads tight.

The heddle frames should be controlled in such a manner that where two joining warp threads are used these are moved in alternation from the upper shed into the lower shed and vice versa in the formation of the first shed and that where a larger even number of joining warp threads are used these are successively moved from the upper shed via the middle shed into the lower shed and back via the middle shed into the upper shed. The warp threads of the tape do not participate in the formation of loops for tying the series of slide fastener links and move only between the middle and lower sheds in the formation of the second shed.

It is suitable to use four joining warp threads. In this case a joining warp thread which has been pushed onto the tuck needle is moved in successive shedding operations into the middle shed, the lower shed, back into the middle shed and then again into the upper shed for a formation of loops. As a result, there are always a descending warp thread and an ascending one in the middle shed.

To improve the support and tying of the series of slide fastener links, additional warp threads of the tape may be fed between the joining warp threads and may participate in the shedding operation performed to weave the strap.

Because a double shot is inserted into each shed formed to weave the strap, i.e., the picking needle moves forth and back in each shed, a selvage consisting of interlaced loops of the successive filling threads is suitably formed on that edge of the strap which is opposite to the series of slide fastener links.

An embodiment of the invention will be described hereinafter more in detail and by way of example with reference to the drawing, in which FIG. 1 is a diagrammatic perspective view showing the warp threads warped on a weaving machine and the series of slide fastener links guided in a tube during the insertion of the filling, and the tucking of that joining warp thread which lies in the upper shed by the tuck needle, whereas all details of the weaving machine not required for an understanding are omitted.

Figure 1:
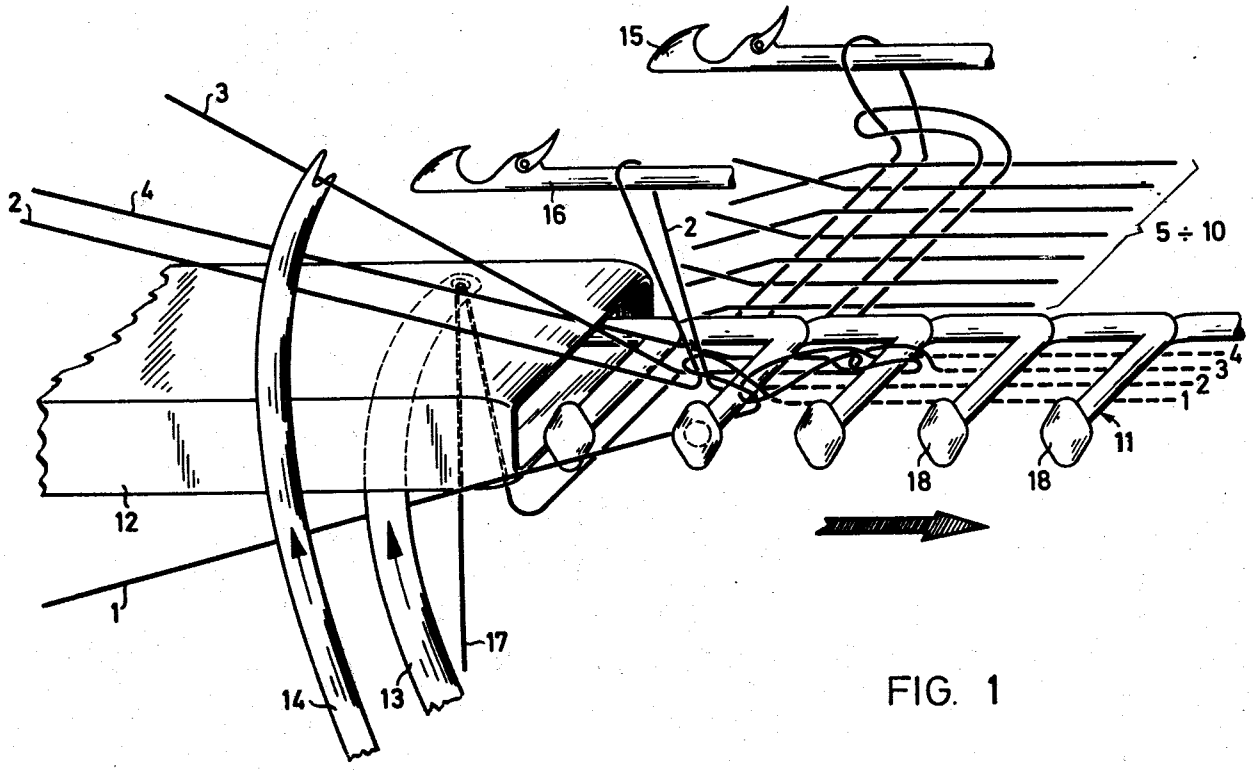

In the drawing, the weaving method of making a slide fastener is illustrated in an embodiment in which four joining warp threads are used, which participate in the formation of loops to tie and fix the series of slide fastener links.

In the weaving machine, joining warp threads 1 to 4 are warped as well as the warp threads 5 to 10 of the tape. The latter warp threads may be increased in number as is desired for a wider tape. The series 11 of slide fastener links is moved along a straight line adjacent to the zero plane *m* of the weaving machine through the tube 12, which is fixed to the machine.

The warp threads for the tape and the joining warp threads are formed into a shed in known manner by heddle frames, not shown. The picking needle 13 and the tuck fork 14 are mounted on a common rocker arm and are reciprocated in parallel planes. The picking needle 13 and the tuck fork 14 are disposed on opposite sides of the tube 12 so that picking needle moves in a plane below the tube 12 and the tuck fork moves in a plane above said tube. The tuck needles 15 and 16 are moved forth and back in known manner for the formation of loops. In its advanced position, the tuck needle 15 takes up the filling thread 17, which has been supplied by the picking needle 13. The tuck needle 16 catches the joining warp thread which has been supplied by the tuck fork 14 and lies in the upper shed.

Figure 2:
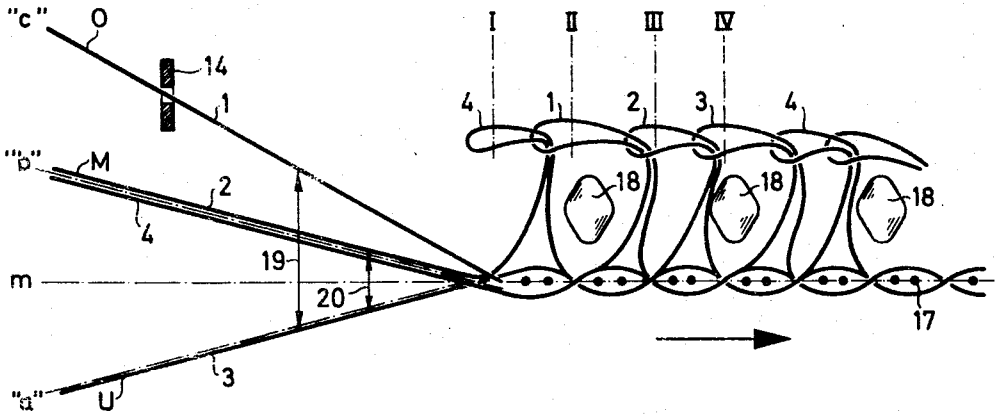
FIG. 2 is a diagrammatic top plan view showing the coupling heads of the series of slide fastener links during the weaving involving a formation of a shed.
Figure 3:
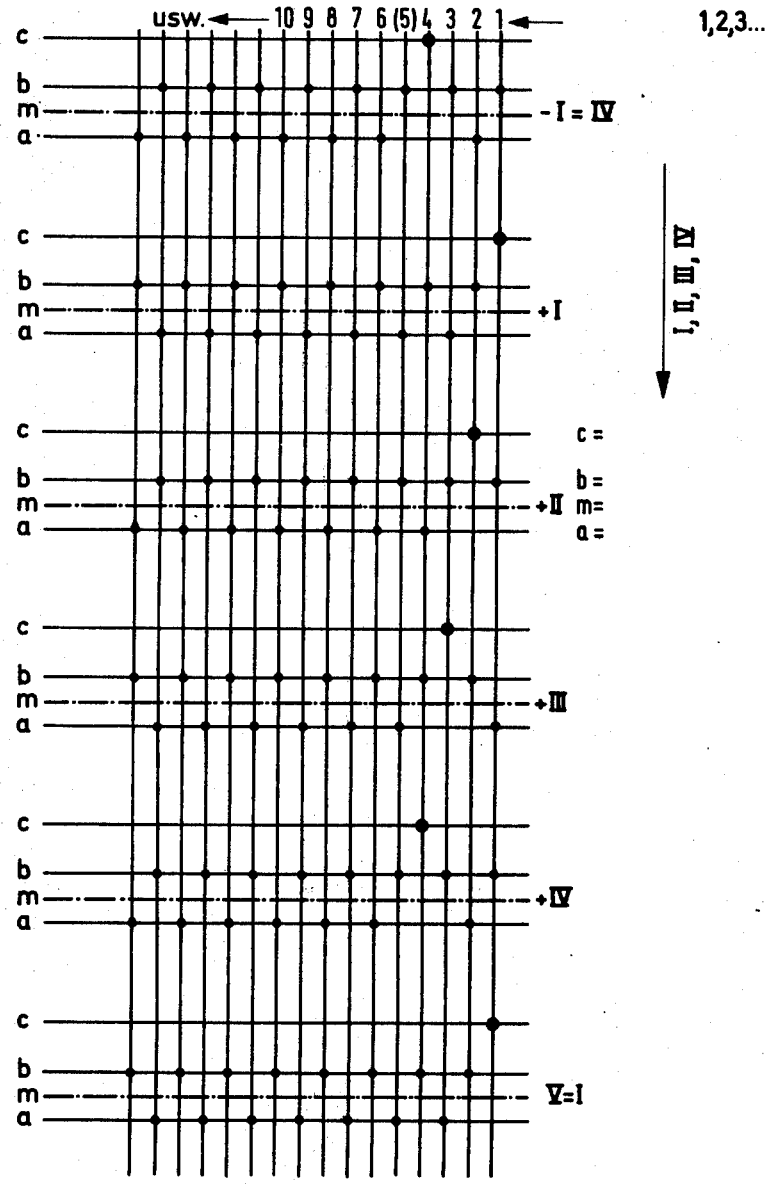
FIG. 3 shows a weaving diagram for a method in which four joining warp threads are employed and FIG. 4 is a top plan view corresponding to FIG. 1.

FIG. 2 illustrates the weaving method in a top plan view on the coupling heads 18 of the series 11 of slide fastener links. In weaving steps I to IV, the joining warp threads 1, 2, 3, 4 are successively formed into loops. At any time, one loop extends over the legs of the series of slide fastener links and the next following loop lies between the legs.

The first shed 19 is formed by the joining warp threads lying in the upper shed O and the lower shed U. The second shed 20 is formed by the warp threads of the carrying tape and the remaining joining warp threads disposed in the middle shed M and the lower shed U.

Figure 4:
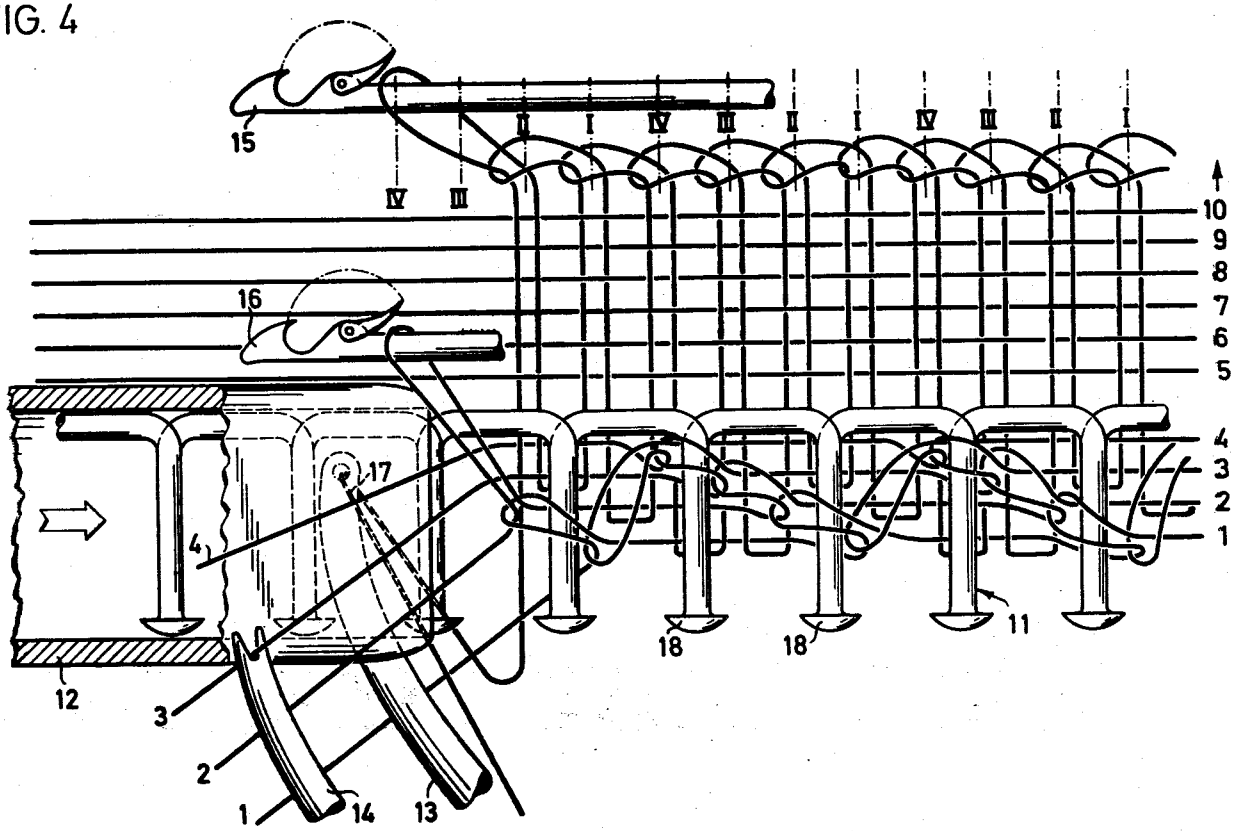

The progress of weaving will now be explained more fully with reference to the diagrammatic FIG. 1 and to FIG. 4. In dependence on the position of the heddle frames, weaving is performed in four steps I to IV, which are repeated in succession. Each weaving step involves a formation of certain sheds. These will be specifically described hereinafter:

POSITION I

Joining warp thread 1 lies in the upper shed C (position *c*).

Joining warp threads 2 and 4 lie in the middle shed M (position *b*).

Joining warp thread 3 lies in the lower shed U (position *a*).

The joining warp thread 3 in position *a* is woven into the tape. As the double shot is inserted, the joining warp thread 1 in position *c* is simultaneously pushed onto the tuck fork 16 by the tuck fork 14 for the next formation of loops.

POSITION II

Joining warp thread 2 in position *c*.
Joining warp threads 1 and 3 in position *b*.
Joining warp threads 4 in position *a*.
Joining warp thread 2 is involved in the next formation of loops. Joining warp thread 4 is woven into the tape.

POSITION III

Joining warp thread 3 in position *c*.
Joining warp threads 2 and 4 in position *b*.
Joining warp thread 1 in position *a*.
Joining warp thread 3 is involved in the next formation of loops. Joining warp thread 1 is woven into the backing woven fabric.

POSITION IV

Joining warp thread 4 in position *c*.
Joining warp threads 1 and 3 in position *b*.
Joining warp thread 2 in position *a*.
Joining warp thread 4 is involved in the next formation of loops. Joining warp thread 2 is woven into the backing woven fabric.

What is claimed is:

1. A method of weaving a slide fastener tape, in which a helical series of slide fastener links is fed parallel to warp threads and filling threads are inserted to weave the tape, characterized in that the helical series of slide fastener links is extended along the plane of warp threads and is moved along a straight line without formation of a shed during the weaving operation, in that at least two joining warp threads are provided and are vertically spaced from the series of slide fastener links and are disposed adjacent the coupling surfaces thereof, that warp threads forming the woven backing fabric extend adjacent the other side of the series of slide fastener links, that said two joining warp threads are moved into upper and lower shed positions to form a first shed while the warp threads forming the woven backing fabric and any remaining joining warp threads lying in a middle shed position and the lower shed position form a second shed, that a double pick weft for weaving the tape is inserted into the second shed and at the same time that joining warp thread of the first shed position which lies in the upper shed is pushed onto a tuck needle to form a chain loop for fixing the series of slide fastener links to the tape, that the joining warp thread lying in the upper shed position is then moved into the lower or middle shed position during a subsequent shedding operation, that the remaining joining warp threads are successively moved into the upper shed position of the first shed after they have participated in the formation of the second shed for weaving the tape, and that selvages are formed at the respective edges of the tape.

2. A method according to claim 1, wherein four joining warp threads are used and a joining warp thread which has been pushed onto the tuck needle is moved in successive shedding operations into the middle shed, the lower shed, back into the middle shed and then again into the upper shed for a formation of loops.

3. A method according to claim 1, further including additional warp threads of the tape are fed between the joining warp threads and participate in the shedding operation performed to weave the tape.

4. A method according to claim 1, wherein a selvage consisting of interlaced loops of the successive filling threads is formed on that edge of the tape which is opposite to the series of slide fastener links.

* * * * *